United States Patent [19]

Weibull

[11] 4,302,191

[45] Nov. 24, 1981

[54] AIMING AND GUNNERY TRAINING APPARATUS

[76] Inventor: John L. Weibull, Möllegarden, S-230 47 Akarp, Sweden

[21] Appl. No.: 133,119

[22] Filed: Mar. 24, 1980

[30] Foreign Application Priority Data

Mar. 28, 1979 [SE] Sweden ..... 7902753

[51] Int. Cl.[3] ..... F41G 3/26

[52] U.S. Cl. ..... 434/20

[58] Field of Search ..... 35/25; 434/20, 14, 22

[56] References Cited

U.S. PATENT DOCUMENTS

| | | | |
|---|---|---|---|
| 2,968,877 | 1/1961 | Becher | 434/20 |
| 3,798,795 | 3/1974 | Michelsen | 35/25 |
| 3,798,796 | 3/1974 | Stauff et al. | 35/25 |
| 3,955,292 | 5/1976 | Robertsson | 434/22 |

FOREIGN PATENT DOCUMENTS

| | | | |
|---|---|---|---|
| 2078693 | 11/1971 | France . | |
| 1117846 | 6/1968 | United Kingdom | 35/25 |

*Primary Examiner*—William H. Grieb

*Attorney, Agent, or Firm*—Eugene E. Geoffrey, Jr.

[57] ABSTRACT

A training apparatus for aiming and gunnery comprises a target tracer, a central control and monitoring unit and equipment at each of a plurality of anti-aircraft guns or other weapons for combatting moving targets. The target tracer is provided with a range finding radar and a TV camera which, by means of an aiming instrument, are continuously held aimed at a moving target. Furthermore, the target tracer has rotational position indicators for indicating the positions of the radar and the camera with respect to a horizontal and a vertical axis. From information obtained from the radar and the indicators, a data processing unit in the central control unit calculates the correct aiming allowance point for each of the weapons, which points can be shown, on the one hand, one at a time on a common TV monitor, and, on the other hand, on a separate TV monitor for each weapon. In both cases, the field of view observed from each respective weapon by means of TV cameras mounted on the weapons, is overlaid on the TV monitor in question, such that on correct aiming of the weapons, the displayed aiming allowance point coincides with the image of the moving target. For checking that the tracing of the target is effected accurately, use is made of the image, obtained from the TV camera of the target tracer, on the common TV monitor.

7 Claims, 2 Drawing Figures

AIMING AND GUNNERY TRAINING APPARATUS

BACKGROUND OF THE INVENTION

The present invention relates to a training apparatus for aiming and firing at movable actual targets with a plurality of weapons intended for such targets, said apparatus comprising a target tracer and an associated data processing unit for deriving magnitudes representing the requisite aiming allowance point of each respective weapon from signals received from the target tracer which indicate range and direction to the target at different points of time, i.e. target parameters, and from magnitudes which represent the performance and position of the weapon, i.e. weapon parameters.

DESCRIPTION OF THE PRIOR ART

For the training of gunners in aiming at moving targets which, when combatted, require aiming allowance, it is known to utilize ranges provided with moving targets. The basic training attained by this form of exercise should suitably be supplemented with realistic field exercises against actual targets. This has, however, hitherto required relatively complicated and very expensive equipment for the efficient utilization of actual target situations with several weapons at the same time.

A prior art example of such equipment comprises a central computer installation which is supplied, from a radar-carrying target tracer, with information concerning the range and direction to a traced target and, furthermore, receives information from azimuth and elevation angle indicators on each weapon concerning the line of aim of each weapon. From the information concerning the range and direction to the target and the information concerning the performance of the weapons involved, the computer installation is able to calculate the azimuth and elevation angle values for each weapon which are necessary to obtain a correct aiming allowance on the target. These rated values can then be compared with the actual values and the differences between them can be demonstrated, for example, by means of two distinguishable points against the background of a simulated sight image on the surface of the TV tube. A system of this type is described in U.S. Pat. No. 3,798,795.

SUMMARY

The object of the present invention is to provide an apparatus of the type disclosed by way of introduction, this apparatus being less complex and less expensive than prior art apparatuses while nevertheless allowing for fully comparable training exercise results.

This and other objects of the invention are attained by means of a training apparatus for aiming and gunnery which is characterised in that a TV camera arranged in parallel with a direct aiming sight of the weapon is mounted on each weapon, the TV camera being connectible, by the intermediary of a mixer unit, to a TV monitor common to the weapons, in which mixer unit a signal corresponding to the magnitude which represents the aiming allowance point of each weapon is combinable with the video signal emanating from the TV camera of the weapon for supply to the TV monitor.

BRIEF DESCRIPTION OF THE DRAWING

With this and other objects in view, the invention consists in the construction, arrangement and combination of the various parts of the apparatus, whereby the objects contemplated are attained, as hereinafter more fully set forth and pointed out in the claims, and illustrated in the accompanying drawing, in which:

DESCRIPTION OF THE PREFERRED EMBODIMENT

Figure 1:
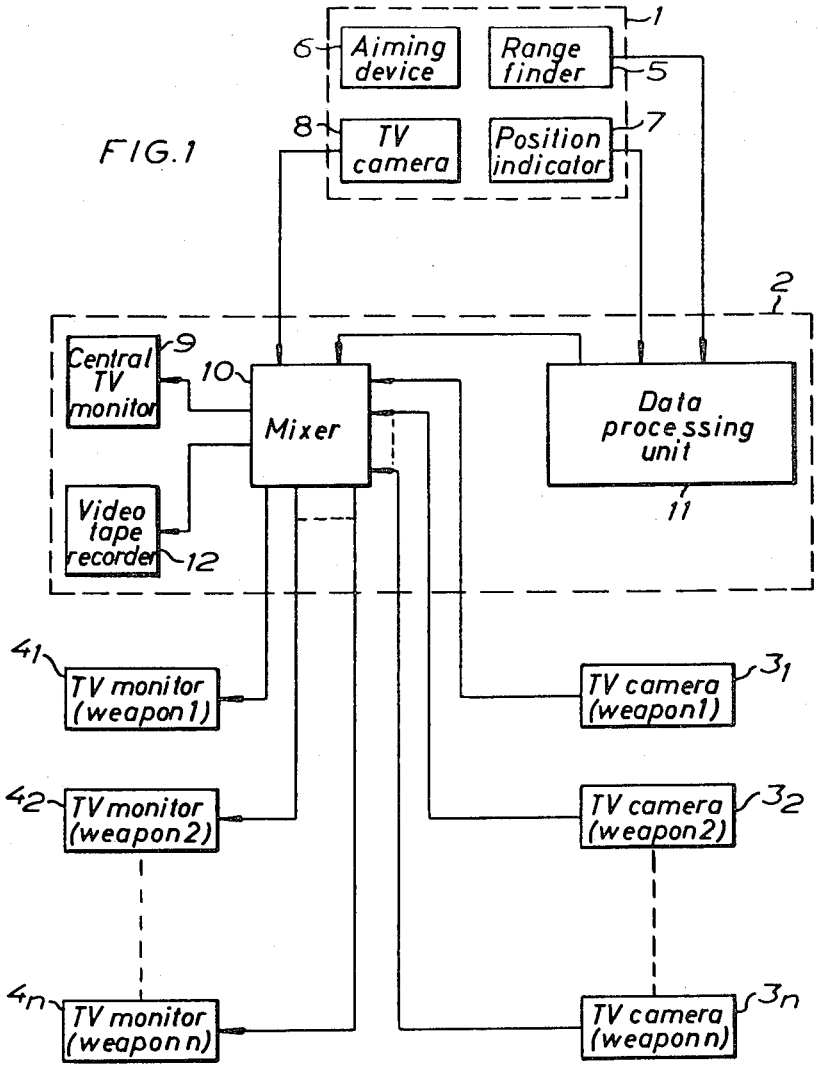
FIG. 1 is a block diagram of one embodiment of an apparatus according to the present invention.

The preferred embodiment of the apparatus according to the present invention illustrated in FIG. 1 comprises a target tracer 1, a central control and monitoring unit 2, and, on each weapon to be used in the aiming exercise, a TV camera $3_1, 3_2, \ldots 3_n$, and a TV monitor $4_1, 4_2, \ldots 4_n$.

The target tracer includes a range finder 5, for example a radar unit, which, together with an aiming instrument 6, is pivotal with respect to a horizontal axis and a vertical axis. Two rotational position indicators 7, for example optoelectrical angle indicators, are arranged to indicate the orientation of the range finder 5 with respect to the two above-mentioned axes. Furthermore, a TV camera 8 is suitably fixedly mounted with respect to the range finder 5.

The central control and monitoring unit 2 consists of a central, common TV monitor 9, a mixer unit 10, a data processing unit 11, for example a microcomputer, and a video tape recorder 12. The data processing unit 11 is connected to the range finder 5 and the indicators 7 in the target tracer 1 for receiving signals which indicate distance and direction, both azimuth and elevation angles, at successive points of time, to a moving target, for example an aircraft, which is traced by means of the aiming instrument 6. As the skilled reader will appreciate, the data processing unit can, on the basis of this information, calculate the range, speed and course of the target at each point of time. With these magnitudes known, and with information that for each of the weapons discloses position and performance (including corrections), the data processing unit 11 can calculate the correct aiming allowance point for each weapon and generate signals representing these aiming allowance points for supply to the mixer unit 10. The mixer unit is coupled so as to receive also video signals from the TV camera 8 of the target tracer 1 as well as from each of the TV cameras $3_1, 3_2, \ldots 3_n$ associated with the weapons. As a result, an optional video signal from the TV cameras $3_1, 3_2, \ldots 3_n$ can be displayed on the central TV monitor 9 together with an image of the corresponding aiming allowance point which is suitably presented as a circle of a diameter dependent upon the distance to the target. Preferably, the diameter of the circle should decrease as the range to the target increases. Similarly, the TV monitors $4_1, 4_2, \ldots 4_n$ are connected to the mixer unit 10 for display of the video signals from the TV cameras $3_1, 3_2, \ldots 3_n$ together with the respective aiming allowance point, which is optionally displayed only when simulated firing of the weapon in question is executed. This can be realized, for example, by the actuation of a switch simultaneously with the discharge of the weapon. Alternatively, however, the actuation can trigger off a separate indication.

Figure 2:
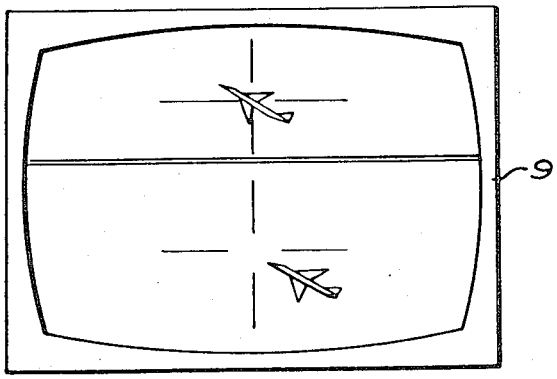
FIG. 2 exemplifies the format of presentation on a common TV monitor.

As is shown in FIG. 2, the image surface of the TV monitor 9 is provided with preferably two fixed cross hairs, of which the TV camera 8 is sighted at the upper, while the TV cameras $3_1, 3_2, \ldots 3_n$ of the weapons are sighted at the lower cross hairs in FIG. 2, like the corresponding cross hairs on the TV monitors $4_1, 4_2, \ldots 4_n$.

In aiming exercise, the target is traced by each weapon with varying aiming allowance, in a normal manner, whereas the target is traced by the target tracer 1 without any allowance at all. The position of the image of the target with respect to the upper cross hairs on the image surface of the monitor 9 shows that the target is being correctly traced by the target tracer 1. Moreover, the aiming allowance of any optional weapon can also be followed on the image surface of the TV monitor 9 with the assistance of the target image produced by the TV camera $3_1, 3_2, \ldots 3_n$ of the weapon in question and the position of the target image with respect to the lower cross hairs on the image surface of the TV monitor 9. The video tape recorder 12 may be used for documentation of a sequence of movements shown on the TV monitor 9, the abovementioned aiming allowance circle being shown.

It might also be mentioned that in a simplified version of the apparatus according to the invention, the TV camera 8 and/or the TV monitors $4_1, 4_2, \ldots 4_n$ may be dispensed with. It might also be mentioned that for the range finder 5 and position indicator 7, use may be made of the range finder and position indicator which are included as components in a central control instrument which is used in the automatic central aiming of anti-aircraft guns.

What I claim and desire to secure by Letters Patent is:

1. Training apparatus for aiming and firing at moving actual targets with a plurality of weapons intended for such targets, said apparatus comprising a target tracer (1) and an associated data processing unit (11) for deriving magnitudes representing the requisite aiming allowance point of each respective weapon from signals received from the target tracer which indicate range and direction to the target at different points of time, i.e. target parameters, and from magnitudes which represent the performance and position of the weapon, i.e. weapon parameters, a TV camera, $(3_1, 3_2, \ldots 3_n)$ arranged in parallel with a direct aiming sight of the weapon and mounted on each weapon, a mixer unit (10) and a TV monitor (9), said TV camera being connectible, by the intermediary of said mixer unit (10) to said TV monitor (9) common to the weapons, whereby a signal corresponding to the magnitude representing the aiming allowance point of each weapon is combinable in said mixer with the video signal emanating from the TV camera of the weapon for supply to the TV monitor.

2. Apparatus according to claim 1, wherein a further TV monitor $(4_1, 4_2, \ldots 4_n)$ is disposed on each weapon for display of substantially the same image as that displayed on the first said TV monitor (9) when the same is connected to the TV camera $(3_1, 3_2, \ldots 3_n)$ of the weapon in question.

3. Apparatus according to claim 1 or 2, wherein a further TV camera (8) is mounted on the target tracer (1) and continuously connected to the first said TV monitor (9), whereby the accuracy of the target tracing procedure may be continuously monitored.

4. Apparatus according to claim 3 wherein the first said TV monitor (9) has stationary cross hairs as reference for the image produced by said further TV camera (8).

5. Apparatus according to claim 1 or 2 wherein each TV monitor $(9, 4_1, 4_2, \ldots 4_n)$ has stationary cross hairs as reference for the image produced by the respective TV camera $(3_1, 3_2, \ldots 3_n)$.

6. Apparatus according to claim 1 or 2 wherein the aiming allowance point on the TV monitor/monitors $(9, 4_1, 4_2, \ldots 4_n)$ is presented as a ring having diameter which varies in relation to the range to the target.

7. Apparatus according to claim 1 or 2 wherein a video tape recorder (12) registers the image displayed on the common TV monitor (9).

* * * * *